US005975948A

United States Patent [19]

Weaver

[11] Patent Number: 5,975,948

[45] Date of Patent: Nov. 2, 1999

[54] COAXIAL CABLE CONNECTOR

[75] Inventor: James Robert Weaver, Lancaster, Pa.

[73] Assignee: The Whitaker Corporation, Wilmington, Del.

[21] Appl. No.: 08/919,489

[22] Filed: Aug. 28, 1997

[51] Int. Cl.[6] ..... H01R 9/05

[52] U.S. Cl. ..... 439/578

[58] Field of Search ..... 439/578, 598, 439/675, 901, 903

[56] References Cited

U.S. PATENT DOCUMENTS

| | | | |
|---|---|---|---|
| 4,392,699 | 7/1983 | Weingartner | 439/686 |
| 4,413,875 | 11/1983 | Mattingly | 439/660 |
| 4,797,122 | 1/1989 | Kuboi et al. | 439/589 |
| 5,295,864 | 3/1994 | Birch et al. | 439/578 |

*Primary Examiner*—Steven L. Stephan
*Assistant Examiner*—Barry M. L. Standig
*Attorney, Agent, or Firm*—Mary K. Vanatten

[57] ABSTRACT

The invention is directed to an electrical connector having an outer metal shell with an inner dielectric insert and a central contact pin received within the dielectric insert. The outer metal shell has a mating end with forward passageway. The outer metal shell has a dielectric insert receiving passageway which is narrower than the forward passageway. A shoulder is disposed along the inner wall between the forward passageway and the dielectric insert receiving passageway. The shoulder being angled towards the forward passageway. The shoulder is deformable over the dielectric insert to secure the dielectric insert within the outer metal shell.

13 Claims, 2 Drawing Sheets

COAXIAL CABLE CONNECTOR

FIELD OF THE INVENTION

The invention is directed towards a coaxial cable connector having a dielectric insert, and the process for securing the dielectric insert within the coaxial cable.

BACKGROUND OF THE INVENTION

A typical coaxial cable connector has a metal outer shell, an inner dielectric insert, and a central contact pin to carry the signal which is secured within the inner dielectric insert. The outer metal shell is crimped to the outer metal braid of the coaxial cable to provide an electrical connection between the shielding of the cable and the connector. The central contact is crimped to the central conductor of the coaxial cable to provide connection for the signal pathway.

In a particular coaxial cable connector, the outer metal shell has a wider internal forward end to receive the mating electrical connector therein. The outer metal shell also has a narrower portion into which the dielectric insert will be secured. There is a right angle shoulder between the wider mating end and the narrower portion for receiving the dielectric insert therein. Once the dielectric insert is inserted within the outer metal shell, it is staked within the outer metal shell. This is accomplished by a special tool which is pushed down within the outer metal shell to engage the shoulder. The tool has a special shape to deform the shoulder and to force portions of the shoulder over the end of the dielectric insert thereby securing the dielectric insert within the outer metal shell.

What is needed is a more reliable method for securing the dielectric insert within the outer metal shell.

SUMMARY OF THE INVENTION

The invention is directed to an electrical connector having an outer metal shell with an inner dielectric insert and a central contact pin received within the dielectric insert. The outer metal shell has a mating end with forward passageway. The outer metal shell has a dielectric insert receiving passageway which is narrower than the forward passageway. A shoulder is disposed along the inner wall between the forward passageway and the dielectric insert receiving passageway. The shoulder is angled towards the forward passageway. The shoulder is deformable over the dielectric insert to secure the dielectric insert within the outer metal shell.

The invention is further directed to a coaxial cable connector for connecting with a coaxial cable comprising an outer metal shell with a forward wider passage and a central narrow passage, and an inner dielectric insert having a forward end. The dielectric insert is received within the central narrow passage. The outer metal shell has a shoulder between the forward wider passage and the central narrow passage. The shoulder is angled towards a mating end of the outer metal shell to form a groove between the shoulder and an inner wall of the outer metal shell. The shoulder is deformable over the forward end of the inner dielectric insert to secure the inner dielectric insert within the central narrow passage.

The invention is further directed to a process for securing a dielectric insert with an outer metal shell of an electrical connector, comprising: providing the outer metal shell with a forward passageway and a narrower dielectric insert receiving passageway, an angled shoulder being disposed between the forward passageway and the narrower dielectric insert receiving passageway; inserting the dielectric insert within the narrower dielectric insert receiving passageway; and staking the dielectric insert within the narrower dielectric insert receiving passageway by inserting a staking punch with a flat end into engagement with the angled shoulders thereby deforming the angled shoulders over a forward end of the dielectric insert and securing the dielectric insert within the shell.

BRIEF DESCRIPTION OF THE DRAWINGS

An embodiment of the present invention will now be described with reference to the accompanying drawings, in which.

DETAILED DESCRIPTION OF AN EMBODIMENT OF THE INVENTION

Figure 1:
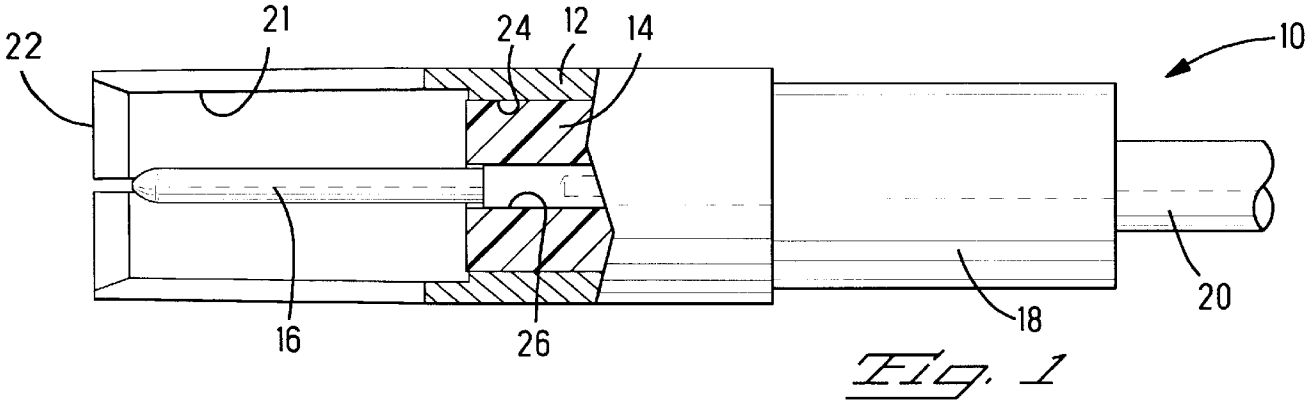
FIG. 1 is a partial cross sectional view of the assembled coaxial cable connector of the present invention.
Figure 2:
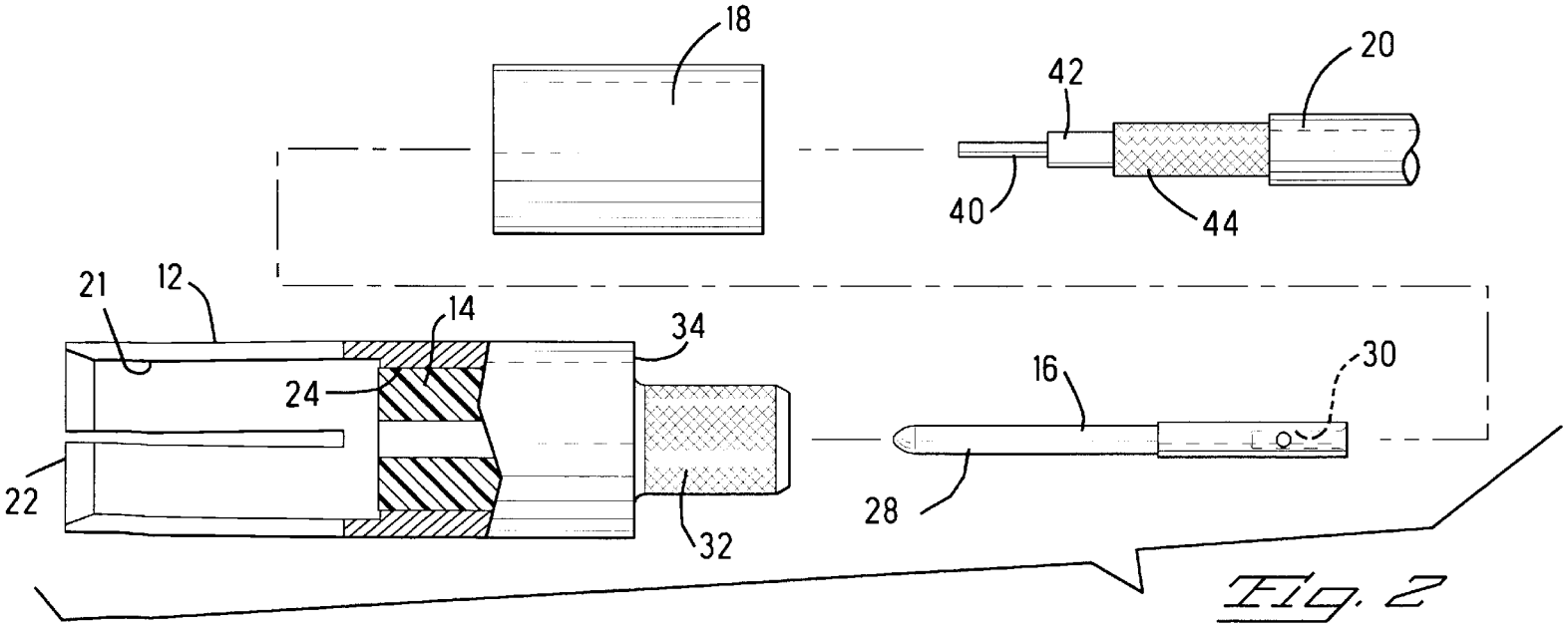
FIG. 2 is an exploded partial cross sectional view of the electrical connector.
Figure 3:
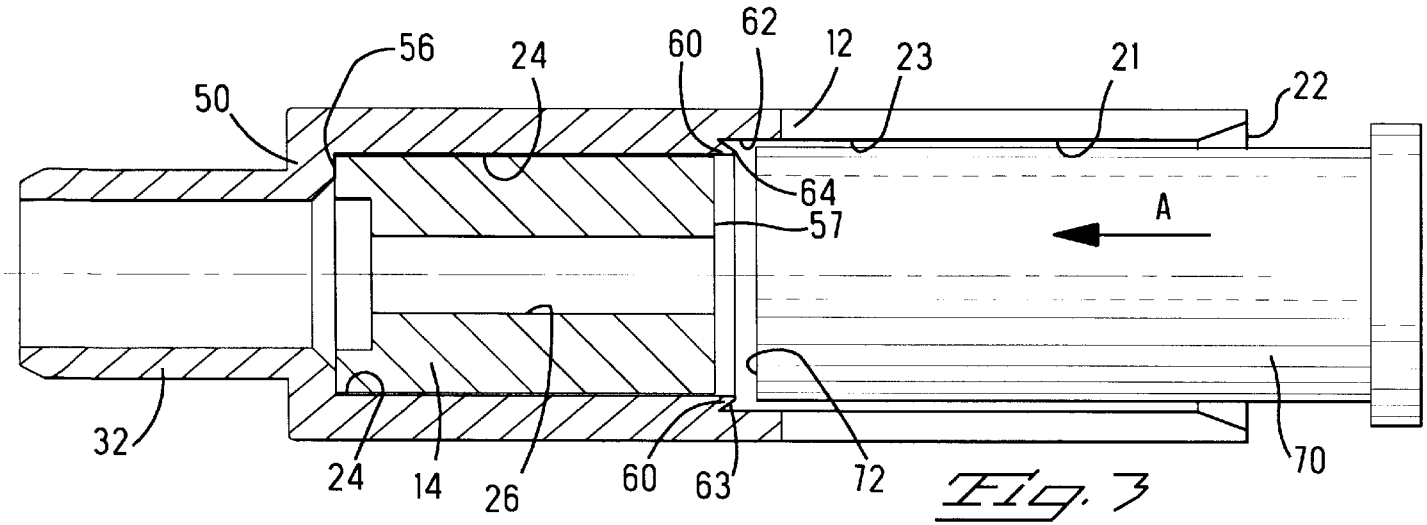
FIG. 3 is a partial cross sectional view showing the coaxial cable and the staking punch prior to staking the dielectric insert.
Figure 4:
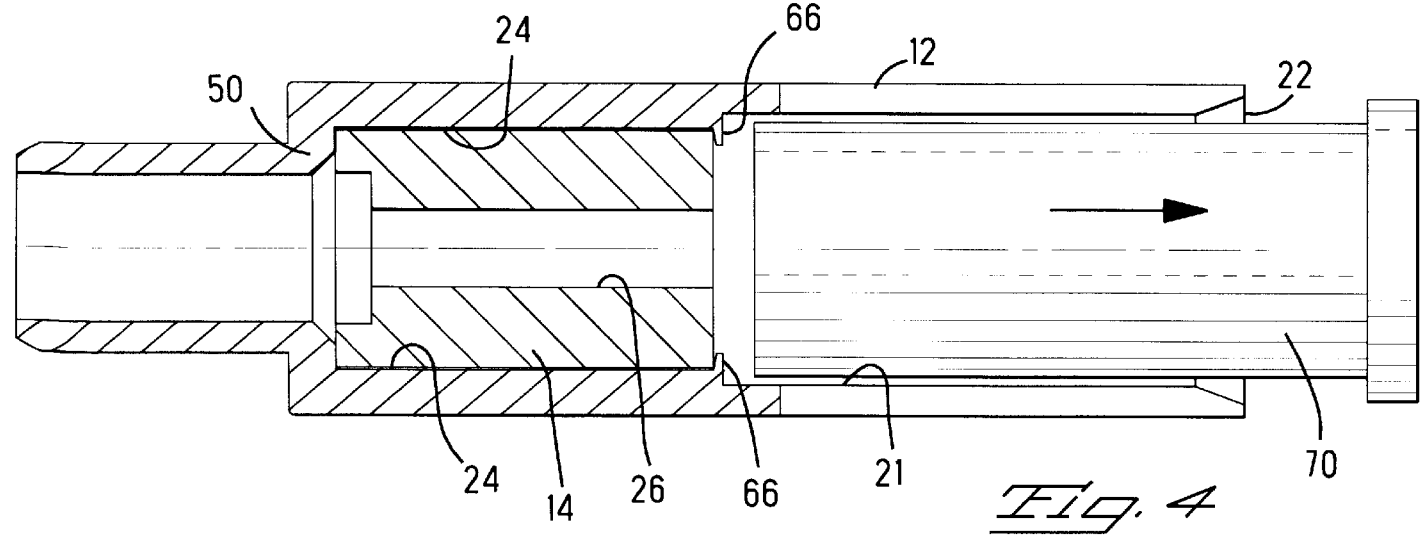
FIG. 4 is a cross sectional view showing the outer shell secured to the dielectric insert.

FIGS. 1 and 2 show the assembled electrical connector of the present invention. FIGS. 3 and 4 show the details of how the dielectric insert is secured within the coaxial cable connector.

FIG. 1 shows a partial cross sectional view of the coaxial cable connector 10 of the present invention. The coaxial cable connector 10 includes an outer metal shell 12, a dielectric insert 14 received and secured within the shell 12, a central contact pin 16 which is received within the dielectric insert 14, and a ferrule 18, all secured to a coaxial cable 20.

The outer metal shell 12 has a forwardly facing mating end 22 into which a mating connector will be received, not shown. The metal shell 12 extends circularly around the mating end 22 and has a wider internal passageway 21. The metal shell 12 also has a narrower internal dielectric receiving passageway 24. The dielectric insert 14 has a contact receiving passageway 26 extending therethrough. The contact pin 16 has a forwardly facing pin 28 and a barrel 30 on the opposite end to receive the central conductor 40 of the coaxial cable 20 therein.

The outer metal shell 12 has a knurled protrusion 32 which extends from a rearward portion 34 of the outer metal shell. The ferrule 18 is a cylinder having a hollow interior, not shown, which is received over the knurled protrusion 32.

During assembly of the coaxial cable connector 10, the central conductor 40 from the coaxial cable 20 is inserted into the barrel 30 of the central pin 16 and crimped thereto. The central pin 16 is then inserted into the dielectric insert 14 and the inner insulation 42 is received within the knurled protrusion 32 up to the dielectric insert 14 to prevent the central conductor 40 from shorting with the outer shell 12. The outer metal braid 44 of the coaxial cable is inserted over the knurled protrusion 32 and the ferrule 18 is received over the outer metal braid 44 and the knurled protrusion 32. The ferrule 18 is crimped to the knurled protrusion 32 and the outer metal braid 44 to provide electrical contact from the outer metal braid 44 to the metal shell 12.

FIGS. 3 and 4 are cross sectional views of the outer metal shell 12 and the dielectric insert 14 showing the details of the present invention. The outer metal shell has the wider internal passageway 21 along the mating end 22, and the narrower internal passage 24 for receiving the dielectric insert 14 therein. Furthermore, there is a necked down portion 50 between the narrower passage 24 and the knurled protrusion 32. When the dielectric insert 14 is inserted into the outer metal shell 12 the rearward end 56 of the dielectric insert 14 will abut against the necked down portion 50 of the outer metal shell 12 thereby preventing further passage of the dielectric insert 14.

The dielectric insert 14 must then be secured within the outer metal shell 12 by staking. In order to do this, the outer metal shell 12 has an angled shoulder 60 disposed between the wider mating end 22 and the narrower passage 24. The angled shoulder 60 includes a ledge which is angled from the inner walls 23 of the outer metal shell 12 at approximately 35 degrees, thereby forming a groove 64 therein. The groove 64 has an outer flat surface 62, an angled wall 63 which is directed towards the mating end 22 and which comes to a point where the angled wall 64 meets the narrow passageway 24. The angled shoulder 60 extends in a circular fashion all around the inner periphery of the outer metal shell 12.

In order to secure the dielectric insert 14 within the outer metal shell 12, a staking punch 70 is used. The staking metal punch has a flat end 72 which is inserted within the outer metal shell 12 with a certain amount of force, in the direction A. When the flat end 72 engages the angled shoulder 60, the angled shoulder 60 is deformed around the forward edge 57 of the dielectric insert 14, as is shown in FIG. 4. The angled shoulder 60 is deformed into a right angled ledge 66 which extends over the forward edge 57 of the dielectric insert 14 and around the inner periphery of the outer metal shell 12 thereby securing the dielectric insert 14 all the way around. The right angled ledge 66 secures the dielectric insert 14 within the narrow internal passageway 24, since the necked down portion 50 prevents the insert 14 from moving in the opposite direction.

The angled shoulder 60 is shown at approximately a 35 degree angle from the inner walls of the outer metal shell 12 however, other angles may prove to be suitable in providing a good stake to secure the dielectric insert with extending the outer metal shell.

The advantage of the embodiment of the present invention is that a staking punch 70 can be used having a flat end 72. It is not necessary to use a specially designed staking punch in order to insure that a good securing ledge is formed along the edge of the dielectric insert. Furthermore, the invention has the advantage that the dielectric insert 14 in not deformed during the staking operation. This keeps the central passageway 26 more precisely centered to receive the contact pin 16. This advantage is particularly important in connectors where it is necessary to have the central contact pin precisely aligned within the coaxial connector.

The electrical connector of the present invention and many of its attended advantages will be understood from the foregoing description. It is apparent that various changes may be made in the form, construction, and arrangement of parts thereof without departing from the spirit or scope of the invention, or sacrificing all of its material advantages.

What is claimed is:

1. An electrical connector, comprising:

an outer metal shell having an inner dielectric insert, the outer metal shell having a mating end with forward passageway, the outer metal shell having a dielectric insert receiving passageway which is narrower than the forward passageway, a shoulder being disposed along an inner wall between the forward passageway and the dielectric insert receiving passageway, the shoulder being angled towards the forward passageway, the shoulder being deformable over the dielectric insert to secure the dielectric insert within the outer metal shell.

2. The electrical connector of claim 1, wherein the angled shoulder has a wall which extends toward the forward passageway thereby forming a groove between inner walls of the forward passageway and the wall of the angled shoulder.

3. The electrical connector of claim 1, wherein the angled shoulder is deformable to form a ledge which is received over a forward end of the dielectric insert.

4. The electrical connector of claim 3, wherein the shell has a rearwardly extending protrusion with a passage therethrough, the shell having a necked down section between the dielectric insert receiving passageway and the passage within the protrusion, the dielectric insert being secured within the shell between the necked down section and the ledge.

5. The electrical connector of claim 1, wherein the dielectric insert has a central passageway with a signal contact received therein.

6. The electrical connector of claim 5, wherein the shell has a knurled protrusion extending from a rearward end of the shell, a cylindrical ferrule being received over the knurled protrusion to secure outer metal braid of a coaxial cable to the shell.

7. A coaxial cable connector for connecting with a coaxial cable comprising an outer metal shell with a forward wider passage and a central narrow passage, an inner dielectric insert having a forward end, the inner dielectric insert being received within the central narrow passage, the outer metal shell having a shoulder between the forward wider passage and the central narrow passage, the shoulder being angled towards a mating end of the outer metal shell, the shoulder being deformable over the forward end of the inner dielectric insert to secure the inner dielectric insert within the central narrow passage.

8. The electrical connector of claim 7, wherein the angled shoulder has a wall which extends toward the forward passageway thereby forming a groove between inner walls of the forward passageway and the wall of the angled shoulder.

9. The electrical connector of claim 7, wherein the angled shoulder is deformable to form a ledge which is received over a forward end of the inner dielectric insert.

10. The electrical connector of claim 9, wherein the shell has a rearwardly extending protrusion with a passage therethrough, the shell having a necked down section between the central narrow passage and the passage within the rearwardly extending protrusion, the dielectric insert being secured within the shell between the necked down section and the ledge.

11. The electrical connector of claim 7, wherein the dielectric insert has a central passageway with a signal contact received therein.

12. The electrical connector of claim 11, wherein the shell has a knurled protrusion extending from a rearward end of the shell, a cylindrical ferrule being received over the knurled protrusion to secure outer metal braid of a coaxial cable to the shell.

13. A process for securing a dielectric insert with an outer metal shell of an electrical connector, comprising:

providing the outer metal shell with a forward passageway and a narrower dielectric insert receiving passageway, an angled shoulder being disposed between the forward passageway and the narrower dielectric insert receiving passageway;

inserting the dielectric insert within the narrower dielectric insert receiving passageway; and staking the dielectric insert within the narrower dielectric insert receiving passageway by inserting a staking punch with a flat end into engagement with the angled shoulders thereby deforming the angled shoulders over a forward end of the dielectric insert and securing the dielectric insert within the shell.

* * * * *